US005231808A

United States Patent [19]

Angelette

[11] Patent Number: 5,231,808

[45] Date of Patent: Aug. 3, 1993

[54] RAILROAD SIGNAL FOUNDATION AND METHOD OF PRODUCING, TRANSPORTING AND ERECTING SAME

[76] Inventor: A. M. Angelette, 4160 Ewing Rd., Austell, Ga. 30001

[21] Appl. No.: 915,270

[22] Filed: Jul. 20, 1992

[51] Int. Cl.[5] ..... B65D 19/00; E02D 27/00

[52] U.S. Cl. ..... 52/122.1; 52/294; 52/745.1; 52/742; 108/55.5; 206/386

[58] Field of Search ..... 108/55.5; 206/386; 52/122.1, 292, 293.2, 294, 477, 745.1, 742

[56] References Cited

U.S. PATENT DOCUMENTS

| | | | |
|---|---|---|---|
| 621,027 | 3/1899 | Callaway | 52/292 |
| 1,529,895 | 3/1925 | La Chance et al. | 52/292 |
| 2,282,452 | 3/1942 | Brown | 52/742 |
| 3,331,496 | 7/1967 | Marsden et al. | 108/55.5 X |

FOREIGN PATENT DOCUMENTS

| | | | |
|---|---|---|---|
| 1072919 | 3/1980 | Canada | 206/386 |
| 7426269 | 2/1976 | France | 206/386 |

*Primary Examiner*—Carl D. Friedman
*Assistant Examiner*—Robert Canfield
*Attorney, Agent, or Firm*—Kennedy & Kennedy

[57] ABSTRACT

A railroad signal foundation assembly 10 comprises a foundation 11 having a concrete base 12, a pillar 13 comprised of tiers of concrete spider blocks 19 mounted upon the base, and a concrete crown 14 mounted upon the pillar. The foundation assembly has a pallet 15 mounted between and extending laterally outward from the crown and base, and mounting bands 16 which secure that pallet aside the pillar. The foundation may be transported as an assembled unit upon the pallet to an erection site, dismounted from the pallet and lowered into a ground hole without a worker being in the hole during its erection.

3 Claims, 3 Drawing Sheets

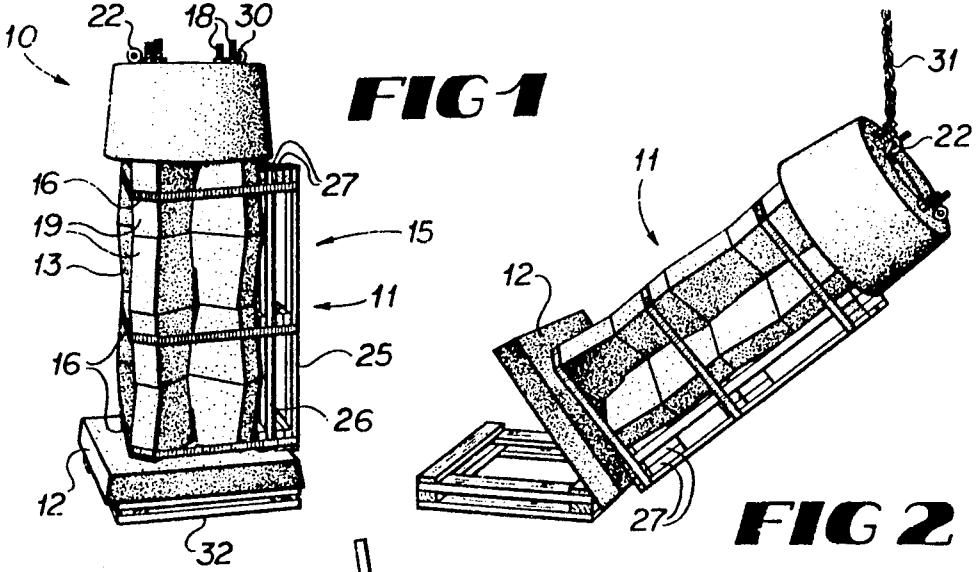
FIG 1
FIG 2
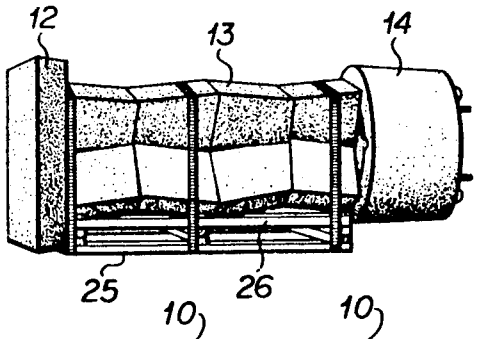
FIG 3
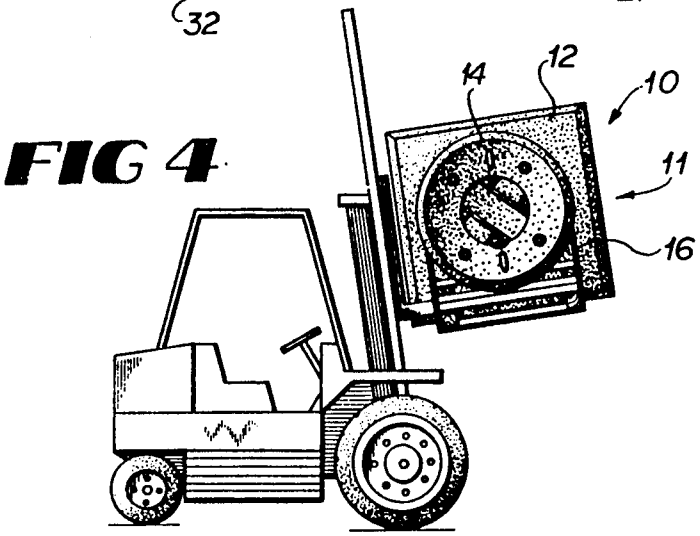
FIG 4
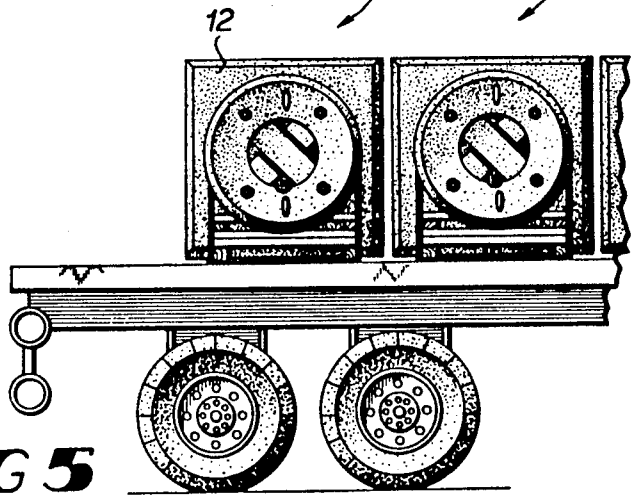
FIG 5

RAILROAD SIGNAL FOUNDATION AND METHOD OF PRODUCING, TRANSPORTING AND ERECTING SAME

TECHNICAL FIELD

This invention relates generally to foundations for railroad signal and traffic control devises, and to methods of producing, transporting and erecting such foundations.

BACKGROUND OF THE INVENTION

Today there exists a vast number of railroad crossings where automotive roads and highways cross railroad tracks. In early times signs were erected at such crossings to warn automotive vehicle drivers of the railroad crossing and thereby avoid the possibility of collision with a train. Later such signs were made larger and equipped with flashing lights. Major crossings were equipped with barrier bars that were automatically raised and lowered in response to the sensed presence of a train. The increase in the size of these signs and signals, and the addition of barrier bars to crossing signals, has meant that these apparatuses have had to be supported on stronger foundations in the ground aside the railroad crossings.

Railroad signal foundations have heretofore been constructed in a number of manners. Some foundations have been formed by merely digging a hole in the ground and filling the hole with concrete to which upright signal masts have been anchored. This has been costly in that it is required that mixed concrete be transported in fluid form to each site.

In more recent years railroad crossing signal and traffic control foundations have been made of precast, steel reinforced, concrete components erected one atop the other in a ground hole. This has typically been done by digging a hole in the ground adjacent a railroad crossing. With workers located both within the hole and above the ground, the foundations have been erected piece by piece by positioning a base on the floor of the hole upon which a relatively slender pillar is built with interlocking blocks to approximately ground level. A crown, sometimes referred to as a doughnut, to which a signal mast may be mounted, is finally mounted atop the pillar and the hole filled.

Foundations of the type just described have proven to be very hazardous and costly to construct. Not only is working in a deep hole in the earth inherently dangerous, but the workers have had to manipulate heavy concrete components as they are successively each lowered by cable into the holes in close proximity to the workers. Many workers have been injured and even killed from time to time from earth avalanches and mishaps in offloading and manipulating the individual concrete components as the foundation is erected within the hole. Additionally, working under such hazardous conditions has caused the time necessary to erect such foundations to be substantial.

Accordingly, it is seen that a railroad signal and traffic control foundation has long remained needed that may be produced, transported and erected in a safe and cost efficient manner. It is to the provision of such therefore that the present invention is primarily directed.

SUMMARY OF THE INVENTION

In a preferred form of the invention a railroad signal foundation assembly comprises a pillar, a base mounted to one end of the pillar which extends laterally outward therefrom, and a crown mounted to another end of the pillar which also extends laterally outward therefrom. The assembly also has a pallet mounted aside the pillar nested between the base and the crown. The pallet is sized and shaped to support the base, pillar and crown above a support surface in an assembled condition for storage and transportation to an erection site.

In another preferred form of the invention a method of producing, transporting and erecting a railroad signal foundation comprises the steps of assembling a foundation by mounting a base to one end of a pillar and mounting a crown to an opposite end of the pillar. A pallet is mounted aside the pillar nested between and extending laterally outward from the base and crown. The palletized foundation is transported as an assembly to an erection site with the foundation supported atop the pallet. The foundation is then dismounted from the pallet and lowered in an upright orientation into a ground hole.

BRIEF DESCRIPTION OF THE DRAWING

FIG. 1 is a perspective view of a railroad signal foundation assembly embodying principles of the invention is a preferred form.

FIG. 2 is a perspective view of the foundation assembly of FIG. 1 being offloaded from an underlying pallet.

FIG. 3 is a perspective view of the foundation assembly of FIG. 1 shown laid upon its side.

FIG. 4 is a bottom view of the foundation assembly of FIG. 1 shown being moved by a forklift truck.

FIG. 5 is a bottom view of the foundation assembly of FIG. 1 shown upon a flatbed truck adjacent other foundations of like construction.

DETAILED DESCRIPTION

Figure 9:
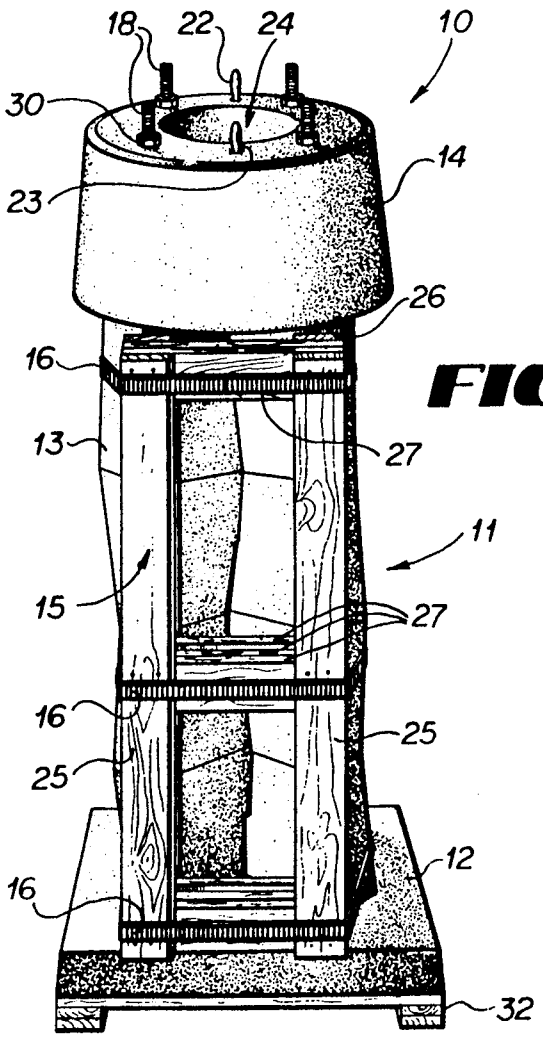
FIG. 9 is a perspective view of the foundation assembly of FIG. 1 in an erected orientation.

With reference next to the drawing, there is shown in FIG. 9 a railroad signal and traffic foundation assembly 10 of the present invention. The assembly 10 has a foundation 11 comprising a base 12, a pillar 13, and a crown 14, all of which are made of precast concrete structures, and a wooden pallet 15 and metallic mounting bands or straps 16. Four guide rods 18 extend from the steel reinforced concrete base 12 through the pillar 13. The pillar itself is comprised of four tiers of interlocked spider blocks 19 with unshown transverse, open top channels. Each tier thus has two conventional, steel reinforced, concrete spider blocks mounted transversely to each other in log-cabin fashion with each block oriented diagonally across the square shaped base so that the base extends laterally outward from the pillar. Each spider block has two tapered holes therethrough that receive the guide rods 18. In assembling the foundation, the spider blocks are lowered one by one into place upon the base 12 and upon each other by passing them down along the guide rods 18 with the pair of each tier fitted together.

The crown 14 is mounted atop the pillar 13 with the guide rods 18 passing through four tapered holes which extend through the crown and which are oriented about a large central hole 24. Such a crown is therefore often referred to as a doughnut. The crown is sized so as to extend laterally from the pillar. The crown, which is of frusto-conical shape, is ruggedized with an annular array of reinforcing steel rods 21. It has two removable lifting eyes 22 threadably mounted into threaded holes 23 in its top. Nuts 30 are mounted on the guide rods 18 flushly atop the crown to secure the base, pillar and crown components together as a complete foundation.

The pallet 15 is comprised of a pair of wooden base boards 25, a pair of wooden mounting boards 26 oriented generally parallel to the base boards 25, and three sets of wooden cross boards 27. Two cross boards 28 of each set are mounted between the base boards 25 and the mounting boards 26 and one cross board of each set is mounted atop the mounting boards 26.

As shown in FIGS. 1 and 9, the pallet 15 is mounted aside the pillar 13 nested between the base 12 and the crown 13 with the base boards 25 of the pallet extending laterally outward beyond the base and crown. Three flexible, metallic, mounting bands 16 are mounted tightly about the pillar and pallet so as to secure them together. Mounted in this manner, the pallet closely abuts the crown and base thereby preventing longitudinal movement of the pallet along the pillar.

Transportation of the foundation assembly may best be understood by sequential reference to FIGS. 1–8. In FIG. 1 the foundation assembly 10 is shown stowed on a small pallet 32 positioned beneath the base 12. To transport the foundation assembly the lifting eyes 22 are threaded into the crown holes 23 so that the foundation assembly may be lifted and lowered with a chain 31 coupled to the lifting eyes. In doing this, the foundation assembly is tilted and lowered off the small pallet 32, as shown being done in FIG. 2, until the foundation is supported horizontally upon its pallet 15 upon the ground, as shown in FIG. 3. The foundation assembly may then be moved with the use of a forklift truck, as shown in FIG. 4, onto a flatbed truck for transportation to an erection site, as shown in FIG. 5. Again, it should be noted that the foundation is supported upon the pallet over the surface of the flatbed truck, thereby preventing the concrete components of the foundation from contacting the hard flatbed surface so as to avoid chipping and breakage. The wooden pallet also acts as a cushion between the foundation and the truck. The foundation assembly 10 may now be transported compactly along with assemblies of like construction without fear of the foundations toppling over.

Figure 8:
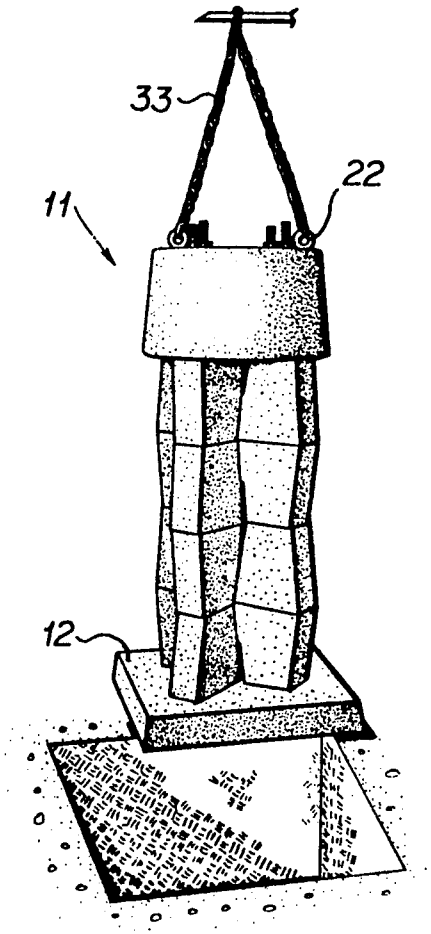
FIG. 8 is a perspective view of the foundation of FIG. 1 shown being lowered into a hole in the ground.
Figure 7:
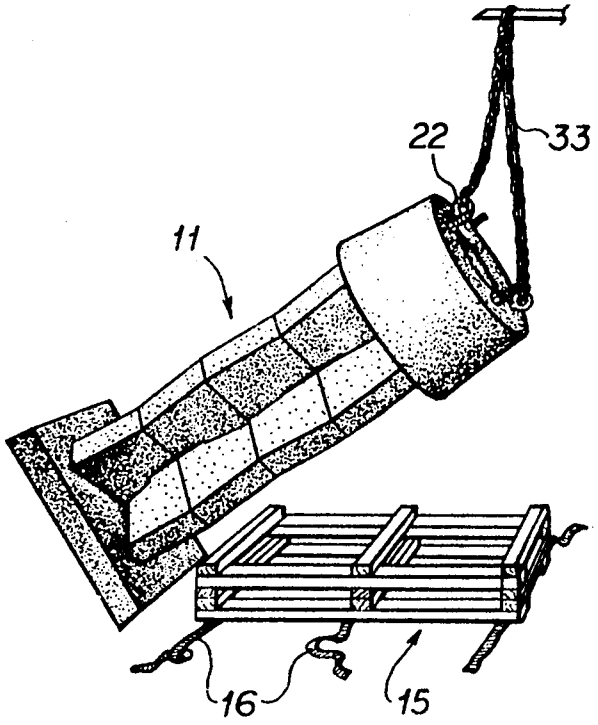
FIG. 7 is a perspective view of the foundation assembly of FIG. 1 with the foundation shown being raised from the pallet.
Figure 6:
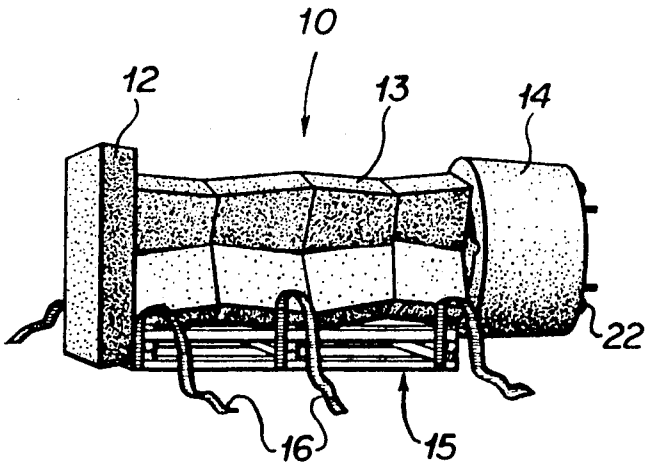
FIG. 6 is a perspective view of the foundation assembly of FIG. 1 shown with its pallet unfastened from the foundation.
Figure 10:
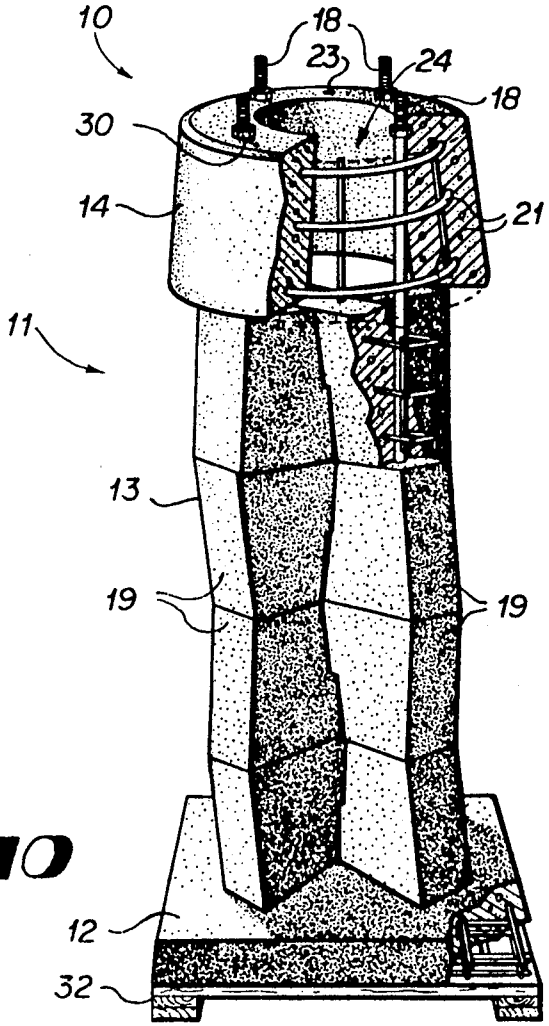
FIG. 10 is a perspective view of the foundation assembly of FIG. 1 shown with portions shown removed to reveal internal components.

Once the assembly arrives at its erection site it is removed from the truck and lowered onto the ground. The mounting bands 16 are then cut as shown in FIG. 6 so that the foundation may be lifted from the pallet. In doing this a chain 33 is coupled to the lifting eyes 22 and the foundation 11 raised to an upright position as shown being done in FIG. 7. The foundation is then lowered into a hole in the ground, as shown in FIG. 8, having a width somewhat greater than the width of the base and a level floor.

It should be noted that there is too small a space between the base and the earth wall of the hole to accommodate a worker. This provides a safety measure as it prevents one from entering the ground hole against standing instructions of his supervisor or foreman during foundation erection. Also, moving and erecting the foundation as an assembled unit eliminates the need for dangerous manipulations of numerous concrete blocks within the confines of a ground hole, as with the construction of foundations in the past.

Once the foundation is properly positioned within the hole, excavated dirt is tightly packed about it so that only an upper portion of the crown is typically exposed above the ground. Finally, the lifting eyes are removed and the railroad signal or traffic control mast is mounted atop the crown.

In a preferred embodiment, the foundation has a height of approximately 5½ feet and a weight of approximately 1,600 pounds. Each spider block has a height of one foot and a weight of 120 pounds. The base 12 of the foundation measures 30 inches square while the crown has a width of 26 inches. Therefore, the hole in the ground should measure at least somewhat larger than 30 inches square. The foundation may be made taller or shorter by merely by adding or removing one or more tiers of spider blocks from the pillar.

It thus is seen that a new railroad signal and traffic control foundation and assembly, and a new method of producing, transporting and erecting such, is now provided that overcomes problems long associated with those of the prior art. It should be understood however that many modifications, additions and deletions may be made thereto without departure from the spirit and scope of the invention as set forth in the following claims.

I claim:

1. A railroad signal foundation assembly comprising a pillar, a base mounted to one end of said pillar extending laterally outward therefrom, a crown mounted to another end of said pillar extending laterally outward therefrom, and a pallet mounted aside said pillar nested between said base and said crown, said pallet being sized and shaped to support said base, said pillar and said crown above a support surface in an assembled condition for storage and transportation to an erection site.

2. A method of producing, transporting and erecting a railroad signal foundation comprising the steps of:

(a) assembling a foundation by mounting a base to one end of a pillar and mounting a crown to an opposite end of the pillar;

(b) mounting a pallet aside the pillar so as to be nested between and extending laterally outward from the base and crown;

(c) transporting the palletized foundation to an erection site with the foundation supported atop the pallet;

(d) dismounting the foundation from the pallet; and (e) lowering the foundation in an upright orientation into a ground hole.

3. The method of claim 2 further comprising the step of digging the ground hole sized sufficiently wide to receive the foundation in its upright orientation but insufficient to accommodate a worker beside the foundation.

* * * * *